United States Patent [19]

Delehonte

[11] 4,206,572

[45] Jun. 10, 1980

[54] DEVICE FOR CONTROLLING EXPANSIBLE GRINDING TOOLS

[75] Inventor: Jack F. Delehonte, Savigny sur Orge, France

[73] Assignees: S.A. Automobiles Citroen; Societe Dites Automobiles Peugeot, both of Paris, France

[21] Appl. No.: 927,870

[22] Filed: Jul. 25, 1978

[30] Foreign Application Priority Data

Jul. 29, 1977 [FR] France ..... 77 25488

[51] Int. Cl.[2] ..... B24B 33/00

[52] U.S. Cl. ..... 51/34 H

[58] Field of Search ..... 51/34 C, 34 H, 165.93, 51/338, 339, 340, 341, 342, 343, 344, 345, 346, 347, 350, 351

[56] References Cited

U.S. PATENT DOCUMENTS

| | | | |
|---|---|---|---|
| 1,796,842 | 3/1931 | Hall | 51/341 |
| 2,007,847 | 7/1935 | Brignoni | 51/340 |
| 2,102,092 | 12/1937 | Quigley | 51/344 X |
| 3,126,672 | 3/1964 | Calvert et al. | 51/34 C |
| 3,287,860 | 11/1966 | Blake | 51/34 H |
| 3,404,490 | 10/1968 | Estabrook | 51/165.93 |
| 3,496,678 | 2/1970 | Engle | 51/344 X |
| 3,670,456 | 6/1972 | Harratt | 51/340 X |
| 4,044,508 | 8/1977 | Frederick | 51/339 X |
| 4,110,938 | 9/1978 | Ito | 51/165.93 X |

FOREIGN PATENT DOCUMENTS

| | | | |
|---|---|---|---|
| 1442115 | 7/1976 | United Kingdom | 51/338 |

*Primary Examiner*—Gary L. Smith
*Assistant Examiner*—Robert P. Olszewski
*Attorney, Agent, or Firm*—Karl F. Ross

[57] ABSTRACT

A device for controlling the expansion of an expansible grinding tool includes control means for effecting controlled axial movement of a cone in the tool. The control means includes a screw engaging a fixed nut and controllably rotatable by a driving motor, the resultant axial movement of the screw being transmitted to the cone. The expansion control device is provided in the form of a removable grinding head unit arranged to be inserted between a grinding machine and the grinding tool. The grinding head unit also includes means for transmitting rotary motion from the grinding machine to the grinding tool.

3 Claims, 4 Drawing Figures

DEVICE FOR CONTROLLING EXPANSIBLE GRINDING TOOLS

BACKGROUND OF THE INVENTION

1. Field of the Invention

This invention relates to grinding machines with expansible grinding tools and in particular to devices for controlling the expansion of the grinding tool.

2. Description of the Prior Art

Expansible grinding tools are used, for example, in the machining of internal bores and grinding machines using such tools comprise means for rotating the tool and a device for controlling the expansion of the tool. The tools themselves comprise in the majority of cases abrasive stones, or diamonds, disposed around the periphery of a support cylinder and able to move radially under the action of axial movement of a cone in the support cylinder. Such movement of the cone can, for example, be effected by a rod integral with the cone and fast for translational movement with a screw engaged with a fixed nut and rotatable via a reduction gear train by a driving motor. In known grinding machines the whole of the expansion control mechanism is carried directly by the frame of the machine. The mounting of the driving motor of the expansion screw on the machine frame makes it necessary to provide a sliding connection between the shaft of the motor and the screw. Moreover, when a breakdown occurs in the expansion control mechanism, the grinding machine becomes unusable until the expansion control mechanism has been repaired.

OBJECT OF THE INVENTION

It is an object of the present invention to provide an improved grinding tool expansion control device which obviates such drawbacks.

SUMMARY OF THE INVENTION

According to one aspect of the invention there is provided a device for controlling the expansion of an expansible grinding tool whose expansion is effected by axial movement of a cone rigid for translational movement with an axially movable expansion rod. The device comprises a rotatable screw fixed for translational movement to the rod, a fixed nut engaged by the screw, and a driving motor arranged to effect controlled rotation of the screw to cause axial movement of the said rod and cone, the device being disposed in a monobloc grinding head unit which can be removably inserted between a grinding machine and the said expansible grinding tool.

In the event of a breakdown of the expansion mechanism, the grinding head is withdrawn and it is replaced by another grinding head in working condition. The down-time of the machine is thus very short, which is very important particularly in the case where the grinding machine is used in a production line for making bores in mass-produced parts.

The driving motor is, preferably, a stepping electric motor with programmed digital control.

The frequency of the pulses supplied to the motor determines the rate of movement of the expansion rod, and thus the expansion and contraction speeds of the grinding tool. It is consequently possible to adjust these speeds accurately by altering this frequency. Moreover, the stroke of the expansion rod depends upon the number of pulses supplied to the motor; the adjustment of this number determines said stroke accurately.

Expansion control devices embodying the invention can be used both with a stone grinding tool and with a diamond grinder. In the first case, the expansion control device can advantageously be provided with a proximity detector arranged to be actuated during the return stroke of the expansion rod by a control element moving with the rod in order to initiate the supply of motor control pulses for the forward stroke. In the second case, the control device can comprise means for transmitting to the motor an auxiliary pulse train after machining a given number of parts, the starting point of the forward stroke of the expansion rod being thereby shifted so as to take up the low wear of the grinding tool.

According to another aspect of the invention, there is provided a grinding head for interposition between a grinding machine and an expansible grinding tool provided with an expansion cone, the head comprising means arranged to transmit rotary motion from the grinding machine to the tool, and control means arranged to control expansion of the grinding tool by controlled linear movement of the expansion cone, said control means including two co-operating threaded elements one of which is fixed and the other of which is couplable for joint linear movement with the cone, and drive means arranged to effect controlled rotation of the movable threaded element, the head being removable as a whole from grinding machine.

BRIEF DESCRIPTION OF THE DRAWING

A grinding head incorporating an expansion control device in accordance with the invention will now be particularly described, by way of example, with reference to the accompanying diagrammatic drawing in which.

DESCRIPTION OF THE PREFERRED EMBODIMENT

Figure 1:
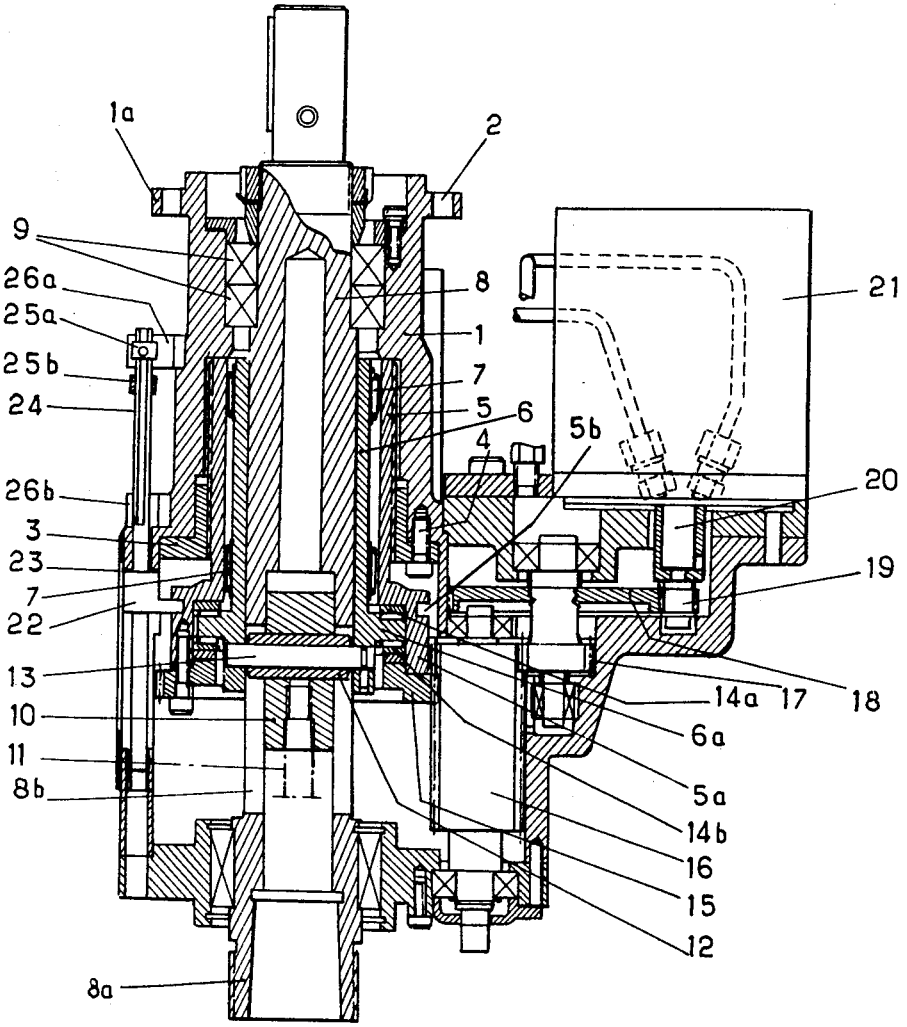
FIG. 1 is an axial cross-section of the head.

As shown in FIG. 1, the grinding head comprises a body 1 which can be fixed to a grinding machine by screws passing through holes 2 of the collar 1*a* of the body 1. A pin 8 rotatably mounted in the body 1 by means of roller bearings 9 serves to transmit rotary motion from the grinding machine to an expansible grinding tool secured to the pin 8 by engagement in a female cone 8*a* provided in the lower end portion of the pin 8, the tool being held there by a lock-nut engaging an external thread of the cone 8*a*.

A nut 3 is fixed by means of screws 4 to the bottom portion of the body 1. A screw 5 is engaged in this nut 3 and extends into an internal space of the body 1. A sleeve 6 is rotatably mounted within an axial through-going hole of the screw 5 by means of a needle rollers (bearings) 7. The sleeve 6 surrounds the pin 8 and is slidable relative thereto.

Figure 2:
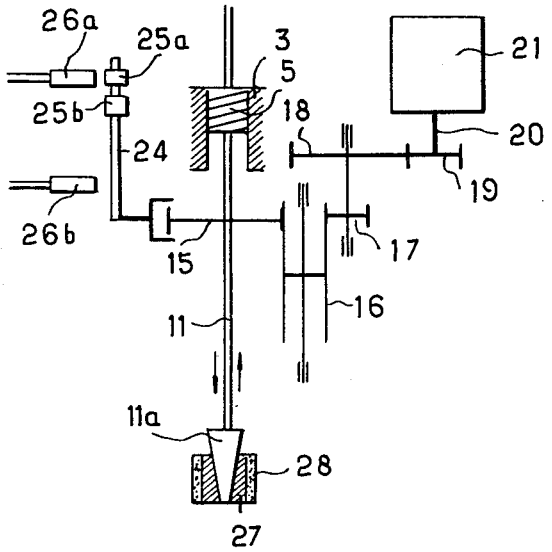
FIG. 2 is a schematic diagram of the expansion control device incorporated in the grinding head.

An auxiliary pin 10 is slidably mounted in the pin 8. An expansion rod 11 is screwed into the lower end of the pin 10 and connects with an expansion cone 11*a* (FIG. 2) of the expansible grinding tool. A bushing 12 extends transversely through the pin 10 and engages in longitudinal ports 8b of the pin 8. The auxiliary pin 10 is thereby rotated by the pin 8 but can slide axially relatively to it.

A shaft 13 extends axially through the bushing 12 and the ends of this shaft engages in the sleeve 6. The sleeve 6 has a shoulder 6a disposed between two needle-bearing abutments 14a and 14b; these abutments are housed in a widened portion 5a of the screw 5 and are retained there by a toothed wheel 15 fixed to the bottom portion of the screw 5. It will thus be seen that the sleeve 6 rotates with the pin 8, but can move axially thereof in unison with axial movement of the screw 5, to move the expansion rod 11 axially.

Axial movement of the screw 5 is effected by rotating the screw 5 relative to the fixed nut 3. To this end, the toothed wheel 15 meshes with a very long pinion 16 which itself meshes with a pinion 17 integral with a toothed wheel 18. The toothed wheel 18 meshes with a pinion 19 keyed on the output shaft 20 of a digitally-controlled stepping electric motor 21. When the output shaft 20 is turned by one step, the screw 5 turns through a certain angle due to the nut 3 being fixed; the screw 5 will also move axially and cause a corresponding axial movement of the expansion rod 11.

The widened portion 5a of the screw 5 has around its periphery a groove 5b in which is engaged an index 22 arranged to move in front of a scale 23. The index 22 is fast with a rod 24 slidably mounted in the body 1 and carrying adjacent its upper end two adjustable control elements 25a and 25b arranged to co-operate with two proximity detectors 26a and 26b.

Digital control of the motor 21 is effected in the usual manner with the control means comprising a pulse generator, means for adjusting the frequency of the pulses to a first value corresponding to a fast feed speed of the expansion rod 11, and to a second value corresponding to a slow feed speed of said rod, and means for adjusting when desired the number of pulses supplied to the motor, both during fast feed and slow feed.

The operation of the described grinding head differs slightly according as to whether the grinding tool is of the stone or diamond type but in general involves the fast forward feed of the expansion rod and cone followed by slow forward feed until machining is completed. The exapnsion rod and cone are then retracted in a return stroke.

When the grinding tool has abrasive stones 28 carried by a support 27, the rate of fast foward feed is set beforehand as is the number of pulses supplied during this fast feed; the rate of the slow forward feed is also preset. The end of slow feed is determined by the generation of an electric signal indicating that grinding has been completed. This signal is produced, for example, by means of an air leak between a nozzle fixed on the grinding tool and the wall of a bore being machined, the variations in air pressure being detected by a mechanical contact arrangement. Alternatively, the signal can be produced by means of a conical ring arranged to enter into a bore being machined to an extent dependent on the bore diameter, a micro-contact being actuated upon the ring entering a predetermined distance into the bore.

Figure 3:
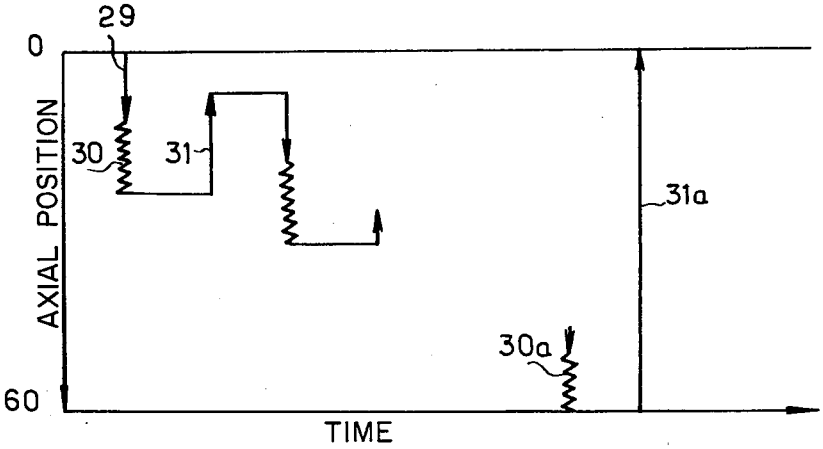
FIG. 3 is a diagram of a grinding cycle in the case of a stone grinder.

On completion of a grinding operation, the expansion rod 11 is retracted until the slide 25a actuates the proximity detector 26a. As a consequence of the wear of the stones, the rod 11 does not return as far as its initial starting point as is shown by FIG. 3 which represents the stroke of the expansion rod 11 in time terms, references 29, 30, 31 respectively indicating the fast feed stroke of the rod, its slow feed stroke and its return stroke.

The actuation of the proximity detector 26b takes place when the stones are fully worn, at the end of a feed stroke 30a. The following return stroke 31a then returns the expansion rod 11 to its starting position to permit a change of stones.

Figure 4:
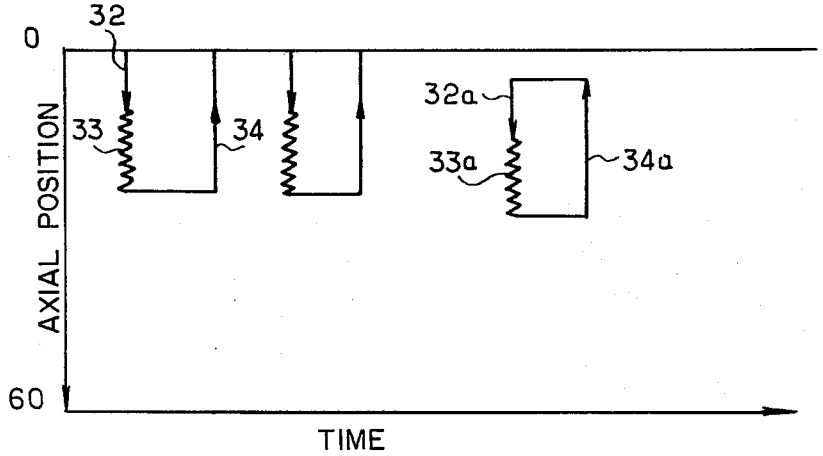
FIG. 4 is a diagram of a grinding cycle in the case of a diamond grinder.

When the grinding tool is of the diamond type, then due to the very low wear of the tool the number of pulses supplied during slow feed can also be preset since the axial position of the cone is itself a sufficient regulator of the grinding operation; as a result, there is no need to provide additional means for indicating that a desired workpiece dimension has been reached. As there is practically no wear on the diamond, the expansion rod returns after each machining oeration to its starting point, as can be seen in FIG. 4, in which references 32, 33 and 34 respectively indicate the fast feed stroke of the rod, its slow feed stroke, and its return stoke.

In order to compensate for any slight wear of the tool that may occur, after the machining of a certain number of parts, the starting point of the run of the expansion rod 11 is staggered by sending to the motor a train of additional pulses. The stroke of the expansion rod after the sending of this train of pulses is shown in FIG. 4 at 32a, 33a and 34a.

If the expansion control device breaks down, the grinding head can be removed from the grinding machine by unscrewing the fixing bolts passing through the holes 2, and replaced by a head in working condition, this operation requiring very little time. The defective head is then repaired independently in the workshop.

I claim:

1. A device for controlling the diameter of an expansible grinding tool whose expansion is effected by axial movement of a rod, said device comprising:

a housing;

a driving shaft journaled in said housing for rotation of said tool;

means in said housing coupling said rod to said shaft for rotation therewith but enabling axial displacement of said rod relative to said shaft;

an elongated tubular screw received in said housing coaxial with said shaft;

a nut fixed in said housing and threadedly engaging said screw;

a driving motor mounted on said housing laterally of said shaft and said screw;

gearing interconnecting said drive motor and said screw for rotation of said screw by said motor, said screw having a toothed crown and said gearing including an elongated output gear having an axis parallel to that of the shaft and the screw and laterally spaced from said shaft but meshing with said crown; and means operatively connecting said screw with said rod at said coupling means for transmitting axial movement of said screw to said rod, said shaft being rotatable relative to said screw in said housing.

2. The device defined in claim 1 wherein the means operatively connecting said rod with said screw includes a sleeve axially extending along said shaft in said housing and having an outward flange, said screw spacedly surrounding said sleeve and having first bearings journaling said sleeve within said screw, said screw having an apron surrounding said flange, said crown being connected to said apron, respective thrust bearings axially flanking said flange and engaging said apron and said crown.

3. The device defined in claim 2 wherein the means connecting said rod with said shaft includes a pin extending transversely of the axis of said shaft and fixed to said rod, said shaft having a pair of longitudinal slots traversed by respective ends of said pin, said ends of said pin being engaged between said crown and said sleeve.

* * * * *